United States Patent [19]

Israeli

[11] Patent Number: 4,588,651

[45] Date of Patent: May 13, 1986

[54] ACCORDION EXPANSION PROCESS

[75] Inventor: Leonardo Israeli, Los Angeles, Calif.

[73] Assignee: Rockwell International Corporation, El Segundo, Calif.

[21] Appl. No.: 466,987

[22] Filed: Feb. 16, 1983

[51] Int. Cl.[4] ..... E04B 2/28

[52] U.S. Cl. ..... 428/594; 29/445; 29/455 LM; 29/157.3 V; 228/157; 52/793

[58] Field of Search ..... 52/793, 807, 299; 29/445, 455 LM, 157.3 V; 228/157, 118; 428/594; 493/966

[56] References Cited

U.S. PATENT DOCUMENTS

| | | | |
|---|---|---|---|
| 2,922,344 | 1/1960 | Meissner | 29/157.3 V |
| 2,953,843 | 9/1960 | Heuer | 29/157.3 V |
| 3,067,492 | 12/1962 | Johnson | 29/445 |
| 3,111,747 | 11/1963 | Johnson | 29/157.3 V |
| 3,112,559 | 12/1963 | Pauls | 29/157.3 V |
| 3,200,489 | 8/1965 | Keeleric | 29/470.9 |
| 3,214,949 | 11/1965 | Johnson | 29/157.3 V |
| 3,319,322 | 5/1967 | Anderson | 29/455 |
| 3,369,288 | 2/1968 | Halnan | 228/157 |
| 3,413,765 | 12/1968 | Williams | 52/807 |
| 3,449,819 | 6/1969 | Blank | 29/470.9 |
| 3,834,000 | 9/1974 | Miller | 29/157.3 V |
| 4,217,397 | 8/1980 | Hayase | 428/594 |
| 4,361,262 | 11/1982 | Israeli | 228/118 |

FOREIGN PATENT DOCUMENTS

| | | | |
|---|---|---|---|
| 218342 | 1/1982 | Austria | 29/157.3 V |

*Primary Examiner*—Henry E. Raduazo

*Attorney, Agent, or Firm*—Charles T. Silberberg

[57] ABSTRACT

A novel method of forming complex structures by using an accordion expansion process is disclosed. The process involves a plurality of flat workpieces of predesigned shapes and sizes that are positioned in such a manner, that after the workpieces have been first joined together, they are expanded to form high strength structural members of complex design.

19 Claims, 7 Drawing Figures

ACCORDION EXPANSION PROCESS

BACKGROUND OF THE INVENTION

The invention relates to a method of forming complex structures and stiffened panel structures, and particularly to an accordion expansion process.

During the past forty years, sandwich and other complex structures have attained widespread use particularly in the aircraft industry in the wings, wall panels, webs of beams, and the like.

A novel forming process, entitled "Method of Making Sandwich Structures" is disclosed in U.S. application Ser. No. 158,845, by Leonardo Israeli, which is incorporated into this specification by reference. This method makes sandwich structures by utilizing two outer workpieces and a plurality of core workpieces that are initially stacked together with portions of the core workpieces being cut out and other portions covered with a stop-off material to prevent diffusion bonding. By applying pressure between the outer workpieces, the core workpieces are expanded to form vertical webs. One disadvantage of these vertical web structures is the lower core stability to normal and shear plate loads as compared to webbing forming oblique angles relative to the outer workpieces. Another disadvantage of the above method is that when the sandwich structure is formed into a chamber having a partially oblique surface, superplastic forming is needed, which requires superplastic materials heated to superplastic forming temperatures. This combining of superplastic forming with accordion expansion causes additional fabrication problems, since superplastic forming temperatures generally are much higher than those temperatures required for accordion expansion.

Superplastic forming properties are exhibited by only a small number of metals and alloys, and the process involves the capability of a material to develop unusually high tensile elongations and plastic deformation at higher temperatures with a reduced tendency toward thinning or necking. (See for example U.S. Pat. Nos. 3,934,441 and 4,181,000). In superplastic forming the workpiece is heated until it becomes superplastic, after which differential pressure is applied causing the workpiece to stretch and form into a cavity. In addition to being limited to a small number of metals and alloys, the excessive stretching may result in non-uniform strength and thickness of the formed structure. The forming process is a complex one with critical parameters (time, temperature, and pressure) controlling the rate of stretching. Necking and ruptures are the direct result of exceeding the narrow tolerances of those parameters.

Diffusion bonding, which is often combined with superplastic forming, is the metallurgical joining of surfaces by applying heat and pressure for a sufficient time as to cause commingling of the molecules at the joint interface. The basic requirement for diffusion bonding is to bring the clean mating surfaces close enough together to allow the inter-molecular attractive forces to become effective.

SUMMARY OF THE INVENTION

It is an object of this invention to provide an improved and new method of forming complex structures (including wings, wall panels, beam webs, propeller and engine blades, stabilizers, and control surfaces) which overcomes the disadvantages of the methods described above.

It is an object of this invention to provide a novel method of forming high strength, complex structures utilizing a wide variety of materials that may be lightweight, inexpensive, and formed at temperatures below superplastic forming temperatures.

It is yet another object of this invention to provide an improved method of forming complex structures and stiffened panel structures by accordion expansion.

It is still another object of this invention to provide an improved method of forming sandwich structures having an oblique core.

Other objects and advantages of this invention will become apparent by reference to the following detailed description taken in conjunction with the accompanying drawings.

The invention is a novel method of making complex structures by using accordion expansion. The method may be used to form either an inclined core in a sandwich structure, an outer workpiece into a forming chamber having an oblique surface, or a free-formed stiffened panel structure. A wide variety of materials may be used which include, but are not limited to aluminum, titanium, and copper, and their respective alloys, as well as plastics, composites, and steel. The preferred embodiment uses titanium and titanium alloys joined by diffusion bonding.

The process allows for the construction of diverse and complex structures. In the process a plurality of workpieces, having two principal opposed surfaces, are cut to predesigned sizes and positioned in a desired stack arrangement. Since the process requires that the workpieces by joined prior to expansion, simple adhesives, brazing, different types of bonding processes (diffusion bonding, deformation bonding, solid state bonding), or welding processes (cold welding, fusion welding, pressure welding) may be used. When diffusion bonding is used, which is the preferred joining process, selected areas of the workpieces are treated with a stop-off material to prevent joining of said selected areas. Under the optimum time, temperature, and pressure conditions for the materials employed, the workpieces are joined together. If diffusion bonding is used, the workpieces are heated to a temperature which is sufficient to produce diffusion bonding of the workpieces at the untreated portions, after which compressive pressure sufficient to cause diffusion bonding is applied.

Pressure is applied internally to the joined workpieces which then expand in an accordion-like manner. Generally, the expansion occurs at elevated temperatures so that the workpieces will not fracture. As used herein "expanded" describes an unfolding process which involves only a small amount of stretching, or elongation, up to about fifteen percent, which may be necessary to form the desired shape. This is contrasted with superplastic forming which is basically a stretching process where stretching of up to and exceeding one hundred percent is not uncommon.

The basic principle of the process is to provide enough combined width of workpieces to unfold to the full designed structural dimension. This applies to both the core and oblique portions of the outer workpiece. The limited elongation following the unfolding process is a simple way to ensure complete unfolding and flatness in metal structures. The accordion expansion process can be used for form thick structures simply by increasing the number and arrangement of core workpieces to be joined together and expanded. That is, by stacking more workpieces on top of each other, the thickness of the structure can be increased appreciably. Also, when only a small amount of elongation is needed (less than fifteen percent), one outer workpiece may provide the elongation.

When a complex structure is being formed (such as a sandwich or a deep dish shape) the total structure thickness with the unfolded inclined web fills a die cavity into which the structure is being fabricated. The die cavity can have one or more oblique surfaces, in which case the sizes and arrangement of the plurality of outer workpieces are predesigned to fit securely upon expansion.

The process can also be used to form stiffened panel structures from a plurality of core workpieces and a bottom workpiece by predesigning the sizes and arrangement of the workpieces, and then expanding by free-forming. After the selective joining pressure is applied to the bottom workpiece and the stiffener workpieces located thereon, the stiffener workpieces expand by freeforming to form stiffened panel structures. As used herein "free-forming" refers to a process where the shape of the stiffener workpieces formed into a tool cavity is either partially controlled or uncontrolled. In uncontrolled "free-forming", pressure is applied internally to the stiffener workpieces, and the finished stiffener shape is curved, forming a cylindrical shape.

DETAILED DESCRIPTION OF THE INVENTION

Figure 1:
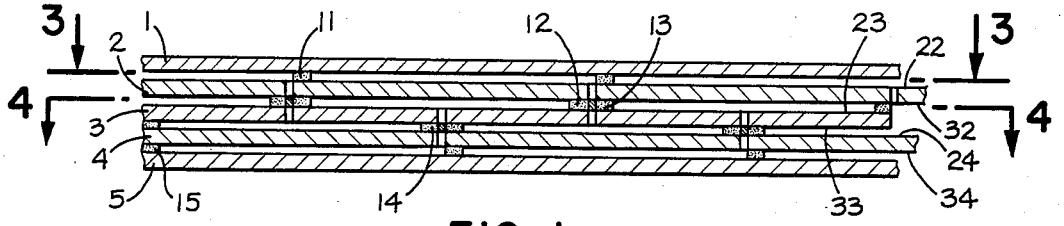
FIG. 1 illustrates a cross sectional elevational view of an assembly having five layers of workpieces of predesigned sizes prior to accordion expansion.
Figure 2:
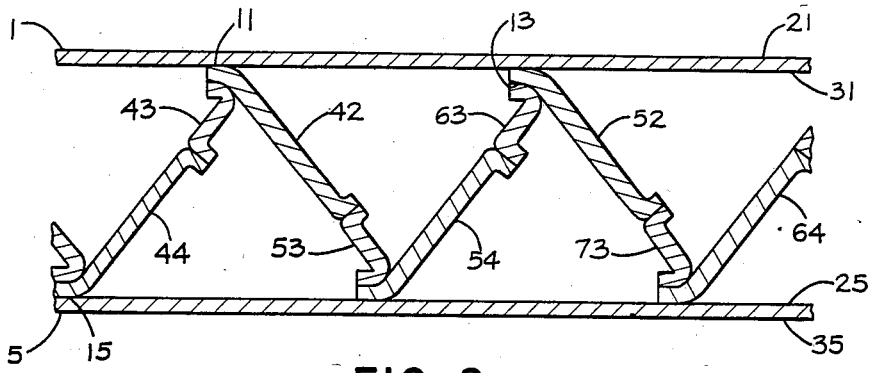
FIG. 2 illustrates the same section shown in FIG. 1 after accordion expansion.

Referring now to the drawings, there is shown in FIG. 2 a section through a finished sandwich structure that is formed by the method of the subject invention. The outer sheets 1 and 5 of the structure have opposed principal surfaces 21, 31, and 25 and 35, respectively. With further reference to FIG. 1, it is seen that sandwiched between the outer sheets 1 and 5 are three core sheets 2, 3, and 4.

Although a sandwich structure can be made having but two core workpieces with accordion expansion, the preferred structure has three core sheets 2, 3, and 4 with opposed principal surfaces 22, 32, and 23, 33, and 24, and 34, respectively. The workpieces may be joined by many processes including, but not limited to adhesives, brazing, bonding or welding. In order to insure that the stack remains aligned, each sheet 1, 2, 3, 4, and 5 is provided with at least two alignment holes (not shown) into which pins (also not shown) can be inserted. Core sheet 2 is comprised of workpieces 42 and 52. Core sheet 3 is comprised of workpieces 43, 53, 63, and 73. Core sheet 4 is comprised of workpieces 44, 54, and 64.

Depicted in FIG. 1 is a section of the assembly to be formed into the sandwich structure shown in FIG. 2. The dark areas of FIG. 1 (e.g., 11, 12, 13, 14, and 15) are the areas between the workpieces 1, 2, 3, 4, and 5 that are to be joined together during the joining step of the present invention. The cutouts (slots) 28 in the core sheets 2, 3, 4 are omitted outside the area of expansion (the frame portion). In other words, if the core sheets 2, 3, and 4 are not designed to expand, the cutouts 28 are omitted.

If diffusion bonding is used for joining the workpieces, the portions of the opposed principal surfaces 31, 22, 32, 23, 33, 24, 34, and 25 not to be joined are separated by a stop-off material or maskant (not shown). An example of the stop-off material is yttria ($Y_2O_3$) which is applied in a suitable binder by a silk screening process.

Core workpieces have expanded to form an inclined web (that is, any inclination less than ninety degrees. See U.S. patent application Ser. No. 158,845). The thickness of the sandwich structure is determined by two die cavity surfaces (not shown) i.e. an upper die surface against principal surface 21 and a lower die surface against principal surface 35.

When the sheets 1, 2, 3, 4, and 5 are inserted into a stack, it is important to maintain small passageways (not shown) to the interior of the stack. The passageways are connected to a pressurized gas system during the expansion step. Inert gas, preferably argon, is used for reactive metal structures.

The stack can be heated to a suitable diffusion bonding temperature (about 1700° F. for Ti—6Al—4V) by heat generated from heating platens (not shown). Pressure is applied to the stack to effect the bonding. After the bonding has been completed, pressurized gas (from 100 to 500 psi for up to 15 minutes) is inserted and circulated through the passageways and the stack. The applied pressure will force the stack to inflate and fill up the die cavity with the two outer sheets 1 and 5, against the upper and lower die surfaces respectively and the core sheets 2, 3, and 3, forming the shape of a predetermined inclined web. Upon expansion, the core workpieces (for example 42, 43, and 44) will unfold and bend about the joined areas, and extend end to end to form the desired sandwich structure. Since most metals at high temperature will stretch up to fifteen percent without any difficulty, this stretching property may be utilized during the expansion step to insure the fixed geometry of the finished structure. The accordion expansion temperature range for 6Al-4V titanium is from 1250° to 1700° F.

Figure 3:
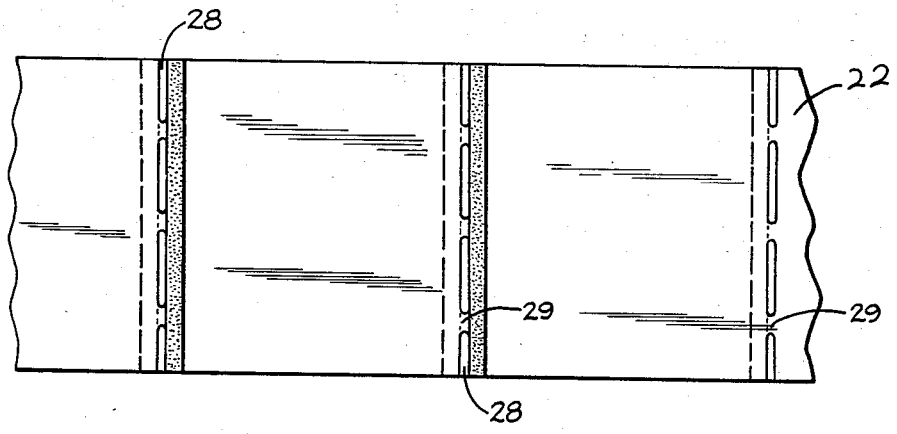
FIG. 3 illustrates Section 3—3 of FIG. 1 prior to accordion expansion.
Figure 4:
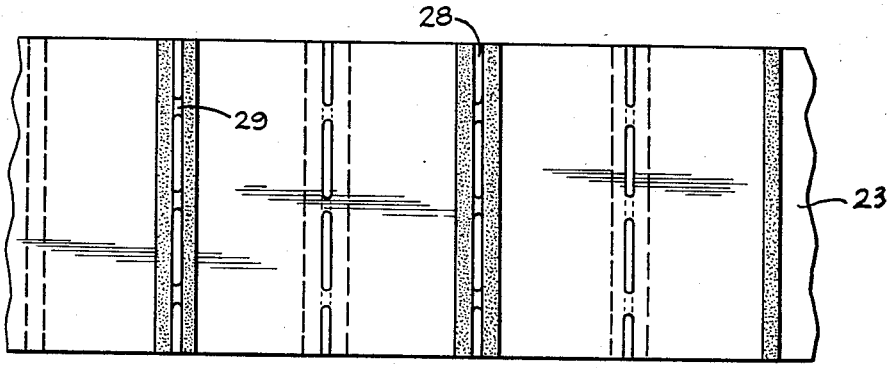
FIG. 4 illustrates Section 4—4 of FIG. 1 prior to accordion expansion.

Referring now to FIG. 3, the drawing shows a top view of a portion of core sheet 2 prior to the joining and expanding. When a plurality of workpieces are used instead of a sheet, positioning the individual workpieces and maintaining the position within narrow tolerances, is difficult. Hence, it is preferred that one core sheet is used for each layer of workpieces, each core sheet having individual cutouts 28 which are applied to each core sheet surface with chemical milling, an electric discharge machine or other methods applicable to the materials involved. To secure the workpieces in position, it is further suggested that narrow slivers (lands) 29 be used that rupture during the forming process, preferably during the expansion step. Referring to FIG. 4, the drawing shows a top view of a portion of core sheet 3, again depicting the individual cutouts 28, and the narrow slivers 29, similar to FIG. 3.

For the inclined core configuration depicted in FIG. 1 and FIG. 2., the predesigning occurs in the following manner. Core workpiece 43 is joined to core workpiece 42 and to the horizontal upper workpiece 1 at point 11. Core workpiece 44 is joined to horizontal bottom workpiece 5 at point 15. During accordion expansion the upper workpiece 1 moves in a vertical plane upward until it contacts the upper die (not shown). Lower workpiece 5 may move in a vertical plane downward until it contacts the lower die (not shown), or lower workpiece 5 may already be in contact with the lower die prior to expansion.

Hence, the horizontal distance between point 11 and 15 does not change during accordion expansion. The position of the forming dies (not shown) determines the vertical distance between the outer workpieces 1 and 5. Therefore, the angle of the core is determined by these vertical and horizontal distances.

Since it is important that each set of core workpieces (e.g. 43 and 44) undergo complete unfolding, it is suggested for metals that the separation of the forming dies be predesigned to require a slight expansion of these core workpieces (less than fifteen percent).

If the thickness of the individual workpieces are not taken into account and the width of the joined areas are not taken into account, and if the stretching is ignored, the following equations can be shown to approximate the length of the individual core workpieces for the FIG. 1 and FIG. 2 configuration.

$$L_1 = \frac{t}{2} \frac{(1 + \text{Cos}\,\theta)}{\text{Sin}\,\theta}$$

$$L_2 = \frac{t}{2} \frac{(1 - \text{Cos}\,\theta)}{\text{Sin}\,\theta}$$

Where

"$L_1$" is the length of the longer core workpiece, e.g. 44

"$L_2$" is the length of the shorter core workpiece, e.g. 43

"t" is the distance between the outer workpieces, and $\theta$ is the acute angle between a core workpiece and an outer workpiece in the expanded condition, e.g. between workpieces 44 and 5

It can be seen that for a vertical core, the angle ($\theta$) is ninety degrees, and the above equations reduce to $L_1 = L_2 = t/2$. Hence, for vertical core, point 11 is positioned directly above point 15.

Figure 5:
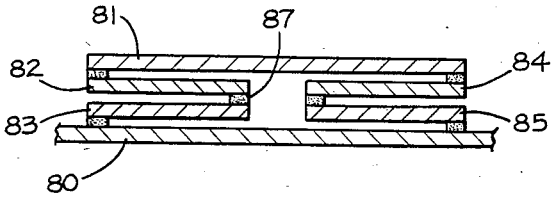
FIG. 5 illustrates a section of an assembly to be formed into stiffened panel structure consisting of a bottom workpiece and stiffener workpieces prior to accordion expansion.
Figure 6:
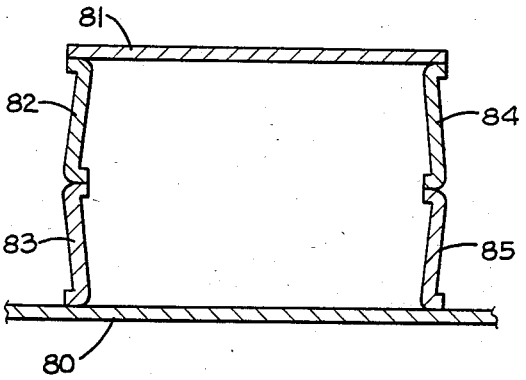
FIG. 6 illustrates the same section shown in FIG. 5, but after accordion expansion in a limiting container.
Figure 7:
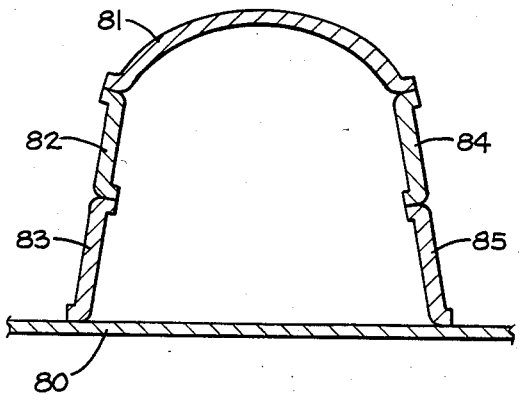
FIG. 7 illustrates the same section shown in FIG. 5 but after free-forming accordion expansion.

Referring now to FIG. 5, there is shown a sample stiffened panel structure having a bottom workpiece sheet 80 and stiffened workpiece 81, 82, 83, 84, and 85 prior to accordion expansion. FIG. 6 and FIG. 7 shows two variations of the FIG. 5 structure after free-forming accordion expansion. FIG. 6 shows partially controlled stiffener workpieces and FIG. 7 shows uncontrolled stiffener workpieces. The areas to be joined (for example 87) during the joining step are shown in FIG. 5.

A chamber having an oblique surface (less than ninety degrees) can be used to shape, for example, one portion of one outer workpiece of a sandwich structure. By predesigning the length and arrangement of the workpieces to fit in an unfolded member into the oblique surface after joining and accordion expansion, superplastic forming materials and superplastic forming temperatures can be avoided.

Accordingly, there has been provided, in accordance with the invention, a method of forming complex structures that fully satisfies the objectives set forth above. It is understood that all terms used herein are descriptive rather than limiting. While the invention has been described in conjunction with specific embodiments, it is evident that many alternatives, modifications, and variations will be apparent to those skilled in the art in light of the disclosure herein. Accordingly, it is intended to include all such alternatives, modifications, and variations that fall within the spirit and scope of the appended claims.

I claim:

1. A method of forming sandwich structures from a plurality of workpieces by accordion expansion, comprising:

providing two outer workpieces, each of said outer workpieces having two opposed principal surfaces;

providing at least two core workpieces, each of said core workpieces having two opposed principal surfaces;

positioning said workpieces in a stack contacting at their principal surfaces, such that said outer workpieces sandwich said core workpieces and at least one core workpiece is superimposed over another core workpiece;

joining at selective areas said core workpieces to each other and to said outer workpieces, said joined areas on opposite outer workpieces being out of vertical alignment; and expanding said joined stack by pressure means into a die, such that said core workpieces unfold and form an inclined web relative to said outer workpieces, with said joined core workpieces being substantially in linear alignment, and such that no one of said core workpieces contacts both of said outer workpieces.

2. The method of forming a sandwich structure as recited in claim 1 wherein said joining is by diffusion bonding.

3. The method of forming a sandwich structure as recited in claim 1 wherein said core workpieces are sheets having cutout portions therein that form a plurality of parallel strips.

4. The method of forming a sandwich structure as recited in claim 3 wherein said sheets with cutout portions have slivers of sheet material that extend through said cutout portions, and said slivers rupture during said forming process.

5. The method of forming a sandwich structure as recited in claim 1 wherein said workpieces have substantially the same outer shape and are positioned evenly in said stack.

6. The method of forming a sandwich structure as recited in claim 1 also including the step of heating said stack to within an elevated temperature range, and wherein said expanding step is performed while said stack is within said temperature range.

7. The method of forming a sandwich structure as recited in claim 6 wherein said core workpieces are elongated during the expansion step, with the elongation being no more than 15 percent.

8. The sandwich structure that is formed by the process recited in claim 1.

9. The method of forming a sandwich structure as recited in claim 1 wherein at least one of said outer workpieces fit into an oblique surface of said forming chamber and form and outer workpiece, with at least an oblique portion.

10. The method of forming a sandwich structure as recited in claim 1 wherein said core workpieces joined together in linear alignment have different lengths.

11. The method of forming a sandwich structure as recited in claim 1 wherein said core workpieces have lengths substantially in accordance with the following relationships:

$$L_1 = \frac{t}{2} \frac{1 + \cos\theta}{\sin\theta}$$

$$L_2 = \frac{t}{2} \frac{1 - \cos\theta}{\sin\theta}$$

where $L_1$ and $L_2$ are the lengths of said core workpieces, t is the distance between said outer workpieces, and $\theta$ is the acute angle between said core workpieces and said outer workpieces.

12. A method of forming stiffened panel structures from a plurality of workpieces by accordion expansion, comprising:

providing a plurality of workpieces, each of said workpieces having two opposed principal surfaces, with a bottom workpiece and at least two of said workpieces being core workpieces;

positioning said workpieces in a stack contacting at their principal surfaces such that at least one core workpiece is superimposed over another core workpiece;

joining at selected locations said core workpieces to each other and to said bottom workpiece; and bringing said workpieces into an elevated temperature range which would allow for stretching deformation of said core workpieces;

inflating the joined stack such that the core workpieces unfold in a free form manner and deflect away from said bottom workpiece; and applying pressure within said joined stack while said workpieces are within said temperature range and after said core workpieces have unfolded such that said core workpieces are elongated.

13. The method of forming a stiffened panel structure as recited in claim 12 wherein said joining is by diffusion bonding.

14. The method of forming a stiffened panel structure as recited in claim 12 wherein said core workpieces are sheets with cutout portions that form a plurality of parallel strips.

15. The method of forming a stiffened panel structure as recited in claim 14 wherein said sheets with cutout portions have slivers of material that extend through said cutout portions, and said slivers rupture during the forming process.

16. The method of forming a stiffened panel structure as recited in claim 12 wherein said inflating step is performed while said stack is within said temperature range.

17. The method of forming a panel structure as recited in claim 12 wherein said core workpieces form a curved surface.

18. The stiffened panel structure that is formed by the process recited in claim 12.

19. The method of claim 12 wherein said elongation of said core workpieces is no more than 15 percent.

* * * * *

UNITED STATES PATENT AND TRADEMARK OFFICE

CERTIFICATE OF CORRECTION

PATENT NO. :4,588,651

DATED : May 13, 1986

INVENTOR(S) : Leonardo Israeli

It is certified that error appears in the above-identified patent and that said Letters Patent are hereby corrected as shown below:

Column 6, line 36, in claim 1, after "being" insert --positioned end to end in--.

Column 6, line 37, after "substantially" delete "in" and after "alignment" and before the comma insert --between the joined areas of the outer workpieces to which they are joined--.

Signed and Sealed this

*Twelfth* Day of *August 1986*

[SEAL]

*Attest:*

DONALD J. QUIGG

*Attesting Officer*

*Commissioner of Patents and Trademarks*